US009949043B2

(12) United States Patent
Racca et al.

(10) Patent No.: US 9,949,043 B2
(45) Date of Patent: Apr. 17, 2018

(54) METHOD AND APPARATUS FOR PRESERVING THE SPECTRAL CLUES OF AN AUDIO SIGNAL ALTERED BY THE PHYSICAL PRESENCE OF A DIGITAL HEARING AID AND TUNING THEREAFTER

(71) Applicant: LINEAR SRL, Genoa (IT)

(72) Inventors: Lucio Giuseppe Racca, I-Genova (IT); Luca Racca, I-Genova (IT); Matteo Racca, I-Milano (IT); Michele Ricchetti, I-Genova (IT); Stefania Repetto, I-Busalla (IT); Sara Sansalone, I-Genova (IT); Roberto Lupo, I-Roma (IT)

(73) Assignee: LINEAR SRL, Genoa (IT)

( * ) Notice: Subject to any disclaimer, the term of this patent is extended or adjusted under 35 U.S.C. 154(b) by 0 days.

(21) Appl. No.: 15/306,494

(22) PCT Filed: Apr. 23, 2015

(86) PCT No.: PCT/IT2015/000115
§ 371 (c)(1),
(2) Date: Oct. 25, 2016

(87) PCT Pub. No.: WO2015/166516
PCT Pub. Date: Nov. 5, 2015

(65) Prior Publication Data

US 2017/0055087 A1 Feb. 23, 2017

(30) Foreign Application Priority Data

Apr. 28, 2014 (IT) ..... GE2014A0036

(51) Int. Cl.
*H04R 25/00* (2006.01)

(52) U.S. Cl.
CPC ..... *H04R 25/505* (2013.01); *H04R 25/356* (2013.01); *H04R 25/407* (2013.01); *H04R 25/70* (2013.01); *H04R 2460/05* (2013.01)

(58) Field of Classification Search
CPC .... H04R 25/70; H04R 25/356; H04R 25/407; H04R 25/453; H04R 25/502;
(Continued)

(56) References Cited

U.S. PATENT DOCUMENTS

2007/0217639 A1* 9/2007 Stirnemann ..... H04R 25/70 381/320
2011/0299709 A1* 12/2011 Anderson ..... A61B 5/121 381/315

FOREIGN PATENT DOCUMENTS

EP 2 640 095 A1 9/2013
EP 2640095 * 9/2013 ..... H04R 25/00

* cited by examiner

*Primary Examiner* — Brian Ensey
(74) *Attorney, Agent, or Firm* — Luoh J. Wu; Continent Patent Office LLP

(57) ABSTRACT

Application of a hearing aid alters the distribution of sound pressure at the tympanic membrane in the ear. Measurements of sound pressure of a free ear and with a hearing aid are performed to evaluate the alteration produced and the in situ frequency response of the hearing aid itself. The following steps are performed: calculating the REUG; calculating a magnitude; calculating one of two components and designing of the filter for the compensation for such component; calculating the REAG; calculating one of two components. The sum of two components is the Insertion Gain; designing the compensating filter of the POST component of the Insertion Gain; testing and verifying, on the subject wearing the hearing aid, the compensating filter of REIG, and possible refinement procedure to correct the compensation of the Insertion Gain obtained in the previous step;
(Continued)

tuning the hearing aid for deafness taking into account the compensating filter.

4 Claims, 7 Drawing Sheets

(58) Field of Classification Search
CPC ..... H04R 25/505; H04R 25/554; H04R 2225/41; H04R 2225/43; H04R 2460/05
USPC ..... 381/312, 320
See application file for complete search history.

METHOD AND APPARATUS FOR PRESERVING THE SPECTRAL CLUES OF AN AUDIO SIGNAL ALTERED BY THE PHYSICAL PRESENCE OF A DIGITAL HEARING AID AND TUNING THEREAFTER

TECHNICAL FIELD

The present invention relates to a method for preserving the spectral cues of an audio signal altered by the physical presence in the hearing canal of a hearing aid or a part of it, and to an apparatus for implementing this method in digital hearing aids that entirely or partially occupy the ear canal.

Digital hearing aids comprise a chip that can be programmed with a specific software, residing on a PC and developed by manufacturers, such as to set and tune the electro-acoustic parameters of the hearing aid.

The hearing aids, commonly called hearing prostheses, are applied to the patient's ears (prosthetization) to solve hearing loss problems. However, a significant percentage of patients treated with hearing aids pleads not satisfied with the results and so does not use them.

In the past, this problem was highly dependent on limitations of the technologies used in the production of hearing aids.

Nowadays, the technology developments have improved the performance of hearing aids; however, the problem of not total satisfaction by patients remains and most people complains about the not adequate speech understanding, for example in noisy environments, while using hearing aids.

In particular, those with hearing loss show a clear difficulty in understanding speech in the presence of noise, and different factors contribute to the auditory deficit, including 1) the reduced audibility of parts of speech (more frequently, the high frequency components) or 2) the reduced frequency selectivity, which confuses the spectral differences and so prevents the frequencies belonging to the speech from be separated from those belonging to the noise, and finally 3) the presence of recruitment, i.e. a reduced auditory dynamics, in which the intensity perception is involved and the perception is either silence or strong, little intelligible "noise".

The factors listed here relate to some defects in the audio signal processing performed by the inner ear sensory receptor, the so-called cochlea.

Recent studies carried out by Vast Audio Pty in Sydney and by the Auditory Neuroscience Laboratory at the University of Sydney [CarlileWolfe2005], [AllenAlaisCarlile2008] have shown that the intelligibility of speech depends on the ability to locate the speaker in the presence of noise and, in particular, this aspect is related to the frequencies above 4 kHz. These frequencies interact with the pinna and in particular with the characteristic convolutions having different sizes and shapes. This means that the difficulty in understanding speech in the presence of noise does not depend entirely on factors related to the malfunction of the cochlea, but can also result from alterations, for example derived from the application and the physical presence in the hearing canal of a hearing aid or a part of it, in the frequency filtering function of audio signals from the outer ear, that is, the pinna and the ear canal.

The function of the pinna is not preserved when applying BTE hearing aids, where the microphone is outside the ear over the pinna, while the function is preserved when applying ITE hearing aids, where all electronic components are inserted within the ear and, in particular, the microphone is located in the natural position for the detection of the audio signal.

The preservation of the frequency filtering function of the external ear, both that related to the location of the audio signal by the pinna and that performed by the ear canal, however, is still an open problem arising from the application of a hearing aid (ITE, BTE, and more generally any hearing aid that entirely or partially occupy the ear canal) resulting in an inevitable alteration in the propagation of the audio signal in the ear canal and, consequently, in the sound pressure at the tympanic membrane (TM).

The effect on the sound pressure at the tympanic membrane by a hearing aid is the Insertion Gain (IG) of the hearing aid and concerns both the ITEs, inserted into the ear canal, and the BTEs, with which the ear canal is occluded by the snail, that is, the tailor-made part deriving from the shape of the ear canal, having inside a tube, connected to the outside electronic part, which brings the audio signal into the ear canal, and, more in general, concerns the hearing aids that entirely or partially occupy of the ear canal.

The Insertion Gain is an objective magnitude from which one can extrapolate the so-called "occlusion effect" of an occluding object that causes a partial or total closure of the ear canal in a subject. In this situation, the subject's voice and other sounds conducted through the body are perceived by the subject himself with an unnatural loudness.

Stated more simply, the occlusion effect corresponds to the Insertion Gain with a hearing aid turned off.

BACKGROUND ART

There are many publications on methods and apparatuses for controlling/reducing occlusion.

Phonak in EP 2640095 proposes a method for tuning electro-acoustic parameters of hearing aids with an active control of the occlusion, that is, by emitting a counter sound in such a way as to cause a destructive interference. The occlusion effect control is built into the programming software of the hearing aids. The compensating filter of EP 2640095 is obtained starting from objective measurements on the subject carried out by means of a sensor (referred to as "channel microphone") inserted into the apparatus and so that to sample the sound in the space remaining between the extremity of the apparatus and the tympanic membrane. These are measurements of REAG (Real Ear Aided Gain), i.e., the sound pressure in the ear canal having an apparatus introduced therein, the first measurement being performed when the apparatus is switched off and the second measurement being performed when the apparatus is switched on and used as a sound source. The acquired signal with the first measure is compared with a REUG signal (Real Ear Unaided Gain), i.e., a sound pressure in the ear canal of a free ear, which is not actually measured but instead "virtually" obtained by filtering the signal of the apparatus's microphone with a filter representing the gain of a free middle ear. That comparison results in the so-called Occlusion Effect Transfer Function (OE). The compensating filter (C) depends on the latter and on the Plant Transfer Function (P). P is the second REAG measurement (Real Ear Aided Gain) during which the apparatus is turned on and used as a sound source.

In the tuning phase of the electro-acoustic parameter of the apparatus, the compensation obtained (C) is applied in feedback mode and only downstream of the amplification required by deafness.

Notwithstanding that the neurosensory deficits related to a malfunction of the cochlea and/or auditory nerve (sensorineural o perceptual hearing loss) and to deficiencies in the brain, at the basis of a central deafness, cannot be solved completely by hearing aids, the application of hearing aids that do not alter the spectral cues of an audio signal give rise to the important result of allowing diseased cochlea to process a so-to-speak "physiological" audio signal, i.e., which corresponds to the one that naturally would be processed in the absence of a hearing aid, with consequent undoubted advantages for any types of hearing loss in terms of perceived audio signal quality and understanding.

By "physiological" we refer to the fact that the spectral cues of an audio signal that are used by the auditory system are also preserved, to determine the direction of origin and that contribute to speech intelligibility in a noisy condition.

DISCLOSURE OF THE INVENTION

The object of the present invention is therefore to provide a method for preserving the spectral cues of an audio signal altered by the physical presence in the hearing canal of a hearing aid or a part of it, and to an apparatus for implementing this method in digital hearing aids that entirely or partially occupy the ear canal, in a tailored manner for the specific user wearing a hearing aid.

The invention provides the performing of accurate measurements of sound pressure: at the tympanic membrane in a free ear (REUR-Real Ear Unaided Response) and in the presence of a hearing aid inserted (REAR-Real Ear Aided Response) at the microphone of the hearing aid and via a microphone outside the ear ("reference microphone"). Both the aforementioned measurements determine the alteration of the spectral cues of an audio signal caused from the hearing aid and allow calculating the relevant Insertion Gain, REIG (Real Ear Insertion Gain). The choice of using a "reference microphone" outside the ear allows to achieving a set of experimental measurements having greater robustness against possible and likely small postural changes of the subject himself. Implicitly, this allows to performing accurate experimental measurements, even using a not-too-sophisticated equipment.

The method according to the invention comprises eight steps, the first seven steps aimed at calculation and correction of the Insertion Gain (REIG) of the hearing aid split into two components, and the eighth step comprising the tuning of the hearing aid taking into account the compensating filter of the Insertion Gain split into two levels of compensation. Following is a brief description of the eight steps of the the method according to the invention:

(A) calculating the REUG (Real Ear Unaided Gain), that is, a comparison between a sound pressure measurement performed with a microphone positioned in the ear near the tympanic membrane and a sound pressure measurement performed with a reference microphone positioned on the face outside the ear;

(B) calculating a magnitude (the so-called ALMIC), i.e., a comparison between a sound pressure measurement at the microphone of the hearing aid inserted in the ear and a sound pressure measurement performed with a reference microphone positioned on the face outside the ear;

(C) calculating one of the two components (PRE) in which, according to the present method, the Insertion Gain (REIG) is split, and designing of the filter for the compensation for such component;

(D) calculating the REAG (Real Ear Aided Gain), i.e., a comparison between a sound pressure measurement performed with a microphone to which a probe tube is connected, which, passing through or externally to the earplug (snail), allows the sound sampling near the tympanic membrane in the ear, and a sound pressure measurement performed with a reference microphone positioned on the face outside the ear. In this step, the settings of the hearing instrument are known and do not depend on deafness.

(E) calculating one of the two components (POST) in which, according to the present method, the Insertion Gain (REIG) is split. The sum of the two components is the Insertion Gain (REIG);

(F) designing the compensating filter of the POST component of the Insertion Gain (REIG);

(G) testing and verifying, on the subject wearing the hearing aid, the compensating filter of REIG, and possible refinement procedure to correct the compensation of the Insertion Gain obtained in the previous step;

(H) tuning the hearing aid for deafness taking into account the compensating filter.

The measurement of step (D) may in some cases not be possible. For example, if the hearing aid or the earplug (snail) more generally, is small, the realization of a through hole through which to introduce the probe tube may not be feasible. On the other hand, the passage of the probe tube outside the earplug is often a critical element, due to a potential air passage which may cause the so-called Larsen effect, commonly known as whistling of the hearing aid.

Even if the REAG measurement (Real Ear Aided Gain) was feasible, it is also affected by some problems such as, for example, the not easy introduction of the probe tube in the ear canal and a particularly low residual space between the extremity of the hearing aid and the tympanic membrane.

For these reasons, an alternative to the REAG measurement (Real Ear Aided Gain) referred to in step (D) and to the calculation of the POST component of the Insertion Gain (REIG) referred to in step (E), the method according to the present invention includes the following steps, $(\overline{D})$ and $(\overline{E})$:

$(\overline{D})$ performing a free field tonal test on the subject wearing the hearing aid inserted and set in such a way that the PRE component of the Insertion Gain (REIG) calculated in step (C) is compensated, the processing is linear and there is no additional amplification required to correct deafness. The tonal test is performed by the presentation of variable frequency tonal stimuli as per UNI EN ISO 8253-2 to which intermediate frequencies are added for a greater accuracy. The result of the tonal test so performed is compared with that of a tonal test performed on the subject without hearing aid.

$(\overline{E})$ the comparison is carried out on a predetermined set of frequencies to produce a set of values that are assigned to equalizing filters inside the hearing aid.

It is observed that the steps $(\overline{D})$ and $(\overline{E})$ of the method allow in one hand to overcome the problems set out above related to the REAG measurement (Real Ear Aided Gain) referred to in step (D), but in the other hand introduce an element of subjectivity related to the tonal tests performed on the subject, which could in some cases compromise the design of the compensating filter of the Insertion Gain (REIG) referred to the next step (F) jeopardizing its effectiveness.

BRIEF DESCRIPTION OF DRAWINGS

Further characteristics and advantages of the proposed technical solution according to the present invention will appear more evident from the following description of a preferred but not exclusive embodiment shown by way of example and not limitation in the accompanying 5 drawings, in which.

BEST MODE FOR CARRYING OUT THE INVENTION

Figure 1:
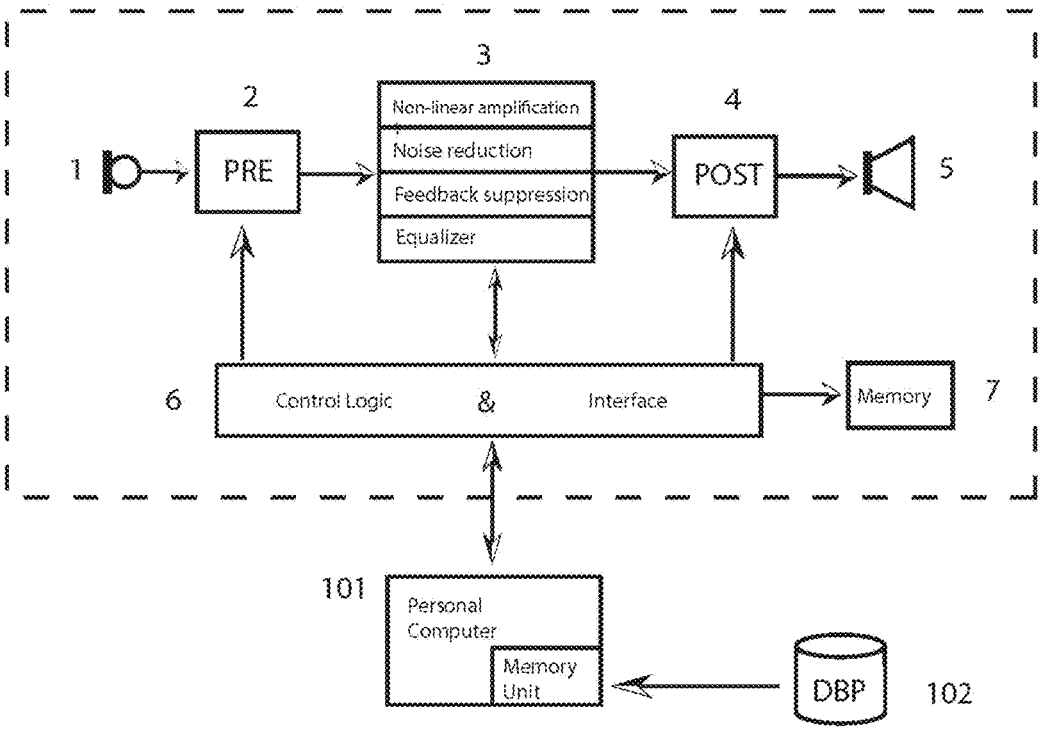
FIG. 1 is a block diagram illustrating the apparatus implementing the method according to the invention.

In FIG. 1 is represented a block diagram that illustrates the apparatus according to the invention, indicated as a whole with the reference number (100).

The apparatus (100) comprises the microphone (1) of the hearing aid, the pre-processing block (2) for the correction of the PRE component of the Insertion Gain (REIG), the deafness-processing unit (3), the post-processing block (4) for the correction of the POST component of the Insertion Gain, the speaker (receiver) (5).

The deafness-processing unit (3), according to the invention, performs a frequency analysis of the signal acquired by the microphone (1), by performing on it the Fourier transform (FFT, Fast Fourier Transform), decomposes the signal thus transformed into a number of channels, that is, frequency bands, on which performs a non-linear amplification and noise reduction algorithms, recomposes the signal, and performs the inverse operation of the Fourier transform (IFFT, Inverse Fast Fourier Transform).

In the deafness-processing unit (3) are also available algorithms for reducing the Larsen effect, equalizers, and volume control. Equalizers can be used for any correction to the compensation of the Insertion Gain performed by the compensating filter, referred to in step (F), during the refinement procedure during the test and verification referred to in step (G).

The apparatus according to the invention (100) can be connected to a personal computer (101) by means of special interface (6).

The personal computer (101) comprises a memory unit UM, which can be, for example, a hard disk.

In the memory unit UM is stored a database DBP (patient database) (102) intended to contain all the data about the person and that can be updated.

The data are the patient's personal data information, the classification of the person based on anthropometric data relating to the ear, the otological and acoustical evaluation of the patient before the prosthetization, and the type of the electronic components of the apparatus, first of all the receiver.

The data contained in the database DBP (102) properly organized will in future be subjected to data mining, in other terms be explored and analysed in order to extract information and make it available to decision-making processes at the basis of the identification of the compensating filters of the Insertion Gain (REIG).

In the memory unit UM also are stored programming modules of hearing aids that, by means of special, are in communication with (100) for exchanging data with it, to be able to program the selected prosthesis by tuning the electro-acoustic parameters.

The pre-processing block (2) in FIG. 1, included in the apparatus (100) according to the invention, achieves a permanent compensation of the PRE component of the Insertion Gain (REIG) of the hearing aid.

The post-processing block (4) performs a permanent compensation of the POST component of the Insertion Gain (REIG) of the hearing aid, which can be corrected by a refinement procedure during the test and verification of the step (G). One possible implementative choice of this correction is based on the use of equalizers in the deafness-processing unit (3).

The permanent compensation of the Insertion Gain (REIG) is made possible by performing measurements of sound pressure at the tympanic membrane of a free ear and with the presence of the hearing aid, performing measurements of sound pressure at the microphone (1) of the hearing aid, and performing measurements of the sound pressure at "reference microphone" (9) outside the ear, as described in steps (A), (B) and (D) of the method.

The permanent compensation of the Insertion Gain (REIG) is also made possible by performing measurements of sound pressure at the tympanic membrane of a free ear, performing measurements of sound pressure at the microphone (1) of the hearing aid, and performing measurements of the sound pressure at "reference microphone" (9) outside the ear, as described in steps (A) and (B) of the method, and by performing the steps ($\overline{D}$) e ($\overline{E}$) of the method.

A graphical representation of these measurements is shown in the following FIGS. 2, 3, 4.

Figure 2:
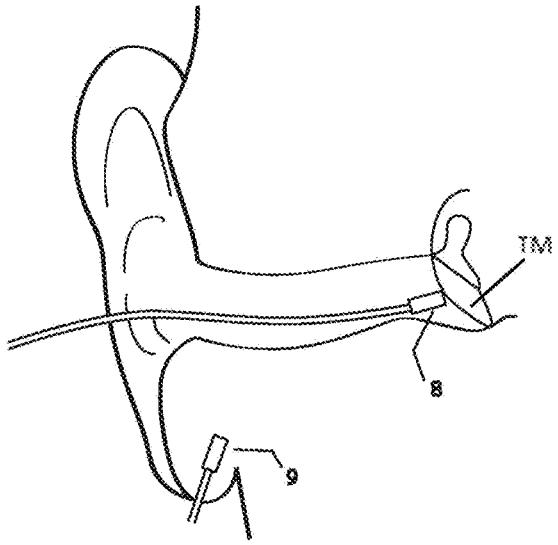
FIG. 2 is a representation of the step (A), that is, the REUG measurement (Real Ear Unaided Gain) carried out with a microphone near the tympanic membrane of a free ear and a microphone outside the ear, positioned on the subject's face.

In FIG. 2 are represented the sampling points for the audio signals that contribute to the REUG measurement (Real Ear Unaided Gain), i.e., the detection of sound pressure carried out by a microphone (8) near the tympanic membrane in the ear and a "reference microphone" (9) outside the ear, positioned on the subject's face. Such measurement is the object of Step (A) of the method according to the invention, a detailed description of which is the following:

Step (A): the REUG measurement (Real Ear Unaided Gain) is a sound pressure measurement performed by a microphone (8) ("measurement microphone") inserted inside the ear canal, near the tympanic membrane, related to a sound pressure measurement performed by the "reference microphone" (9) outside the ear, positioned on the subject's face at about 2 cm from both the tragus and the antitragus. The "measurement microphone" (8) detects the sound pressure near the tympanic membrane of a free ear, i.e., without hearing aid (REUR—Real Ear Unaided Response). The "reference microphone" (9) is used to detect the sound pressure at the ear, outside of it, after equalization of the same. The equalization method used is of simultaneous type, which is performed during the measurement itself. The resulting correction is made during generation of the sound stimulus, i.e., the emission of the stimulus is tuned according to the need to produce at the "reference microphone" (9) a constant sound pressure level during the measurement. The REUG measurement is obtained by comparing the REUR measurement (Real Ear Unaided Response) with sound pressure measurement at "reference microphone" (9).

A logarithmic representation (decibels) in the frequency domain is calculated by the REUR measurement referred to in step (A), and the difference with respect to the logarithmic representation (decibels) in the frequency domain of the respective sound pressure measurement performed with the "reference microphone" (9) is calculated, thus obtaining the logarithmic representation (decibels) in the frequency domain of REUG. Alternatively, in case of non-logarithmic representation, a quotient can be calculated.

Figure 3:
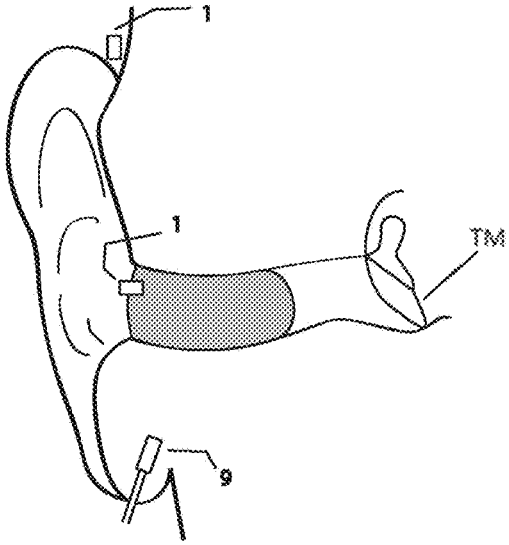
FIG. 3 is a representation of the step (B), that is, the measurement performed at the microphone of the hearing aid applied to the ear of the person and a microphone outside the ear, positioned on the subject's face (ALMIC measurement)

In FIG. 3 are shown the sampling points for the audio signal that contribute to ALMIC measurement performed with the microphone of the hearing aid (1) which, depending on the type of hearing aid, may be located outside the ear, above the pinna or within the ear canal, and a "reference microphone" (9) outside the ear, positioned on the subject's face. Such measurement is the object of Step (B) of the method according to the invention, a detailed description of which is the following:

Step (B): the sound pressure measurement performed with the microphone of the hearing aid (1) applied to the ear, made possible by having prepared, during the construction phase of the hearing aid, the interception of the electrical signal to the microphone (1), is put in relation to the sound pressure measurement at the "reference microphone" (9). From the comparison originates the measurement hereinafter called ALMIC measurement.

The method according to the invention provides that the hearing aid is turned on during the measurement referred to in this step (B).

A logarithmic representation (decibels) in the frequency domain is calculated by the sound pressure measurement at the microphone of the apparatus (1) referred to in step (B), and the difference with respect to the logarithmic representation (decibels) in the frequency domain of the respective sound pressure measurement performed with the "reference microphone" (9) is calculated, thus obtaining the logarithmic representation (decibels) in the frequency domain of ALMIC. Alternatively, in case of non-logarithmic representation, a quotient can be calculated.

Step (C): after obtaining the logarithmic frequency domain representations of REUG and ALMIC, the component of the Insertion Gain (REIG) to be corrected/compensated, herein called PRE, is calculated.

This component is calculated as the difference between the logarithmic frequency domain representations of ALMIC and REUG, i.e., ALMIC-REUG. It is also expressed in logarithmic scale (dB) and covers a range of frequencies ranging from 100 Hz to 10000 Hz. It represents the effect of the hearing aid on the acoustic behaviour of the ear canal. The closure of the auditory canal results in the translation of the main resonance of the canal from the frequency of about 2700 Hz to higher frequencies, which are greater than the maximum frequency considered of 10000 Hz. Further effect of the closure, depending on the position of the microphone of the hearing aid with respect to the canal, is the more or less great gain loss naturally provided by the hollow part of the outer ear and associated to frequencies above 4 kHz involved in sound localization.

The PRE component represents both of these effects, and therefore describes the alteration produced by a hearing aid on the frequency filtering that the outer ear (pinna and ear canal) operates on the audio signal that propagates therein.

It is worth highlighting that the PRE component as calculated in step (C) of the method according to the invention does not depend on the direction of origin of sound and therefore is valid regardless of the direction with which the sound affects the ear.

Once the REIG component, PRE, is calculated, the compensating filter of that component will be designed.

The design strategy is based on an optimization algorithm not constrained to average p-th error, where p are values ranging from 2 to 128. The optimization is achieved when the average p-th error is minimized.

The correction of the PRE component of REIG performed in the block (2) of the apparatus according to the invention is carried out on the signal received by the microphone (1) of the hearing aid immediately after being digitized. In this way, at the block (3) of the apparatus according to the invention that implements the deafness processing is received a broadband signal that is not altered by the closure of the ear canal by the hearing aid, that is, a signal spectrally equivalent to a signal if the ear canal was free. By "spectrally equivalent", we refer to the fact that the spectral cues that are used by the auditory system are also preserved, to determine the direction of origin and that contribute to speech intelligibility in a noisy condition. In other words, we could describe the effect of this operation emphasizing the physiological aspect. The deafness-processing unit (block (3)) will implement these calculations on a signal equivalent to what would come naturally to the tympanic membrane in the ear of the subject in the absence of hearing aid, with consequent undoubted advantages in sound quality perceived by the subject and then in the understanding.

The restored physiological condition has also obvious positive effects in terms of facilitating the strategy of the hearing care professional for signal deafness processing with consequent shortening of the time required for an effective prosthetization of the subject.

Once translated in the programming software, the filter is not changed.

Figure 4:
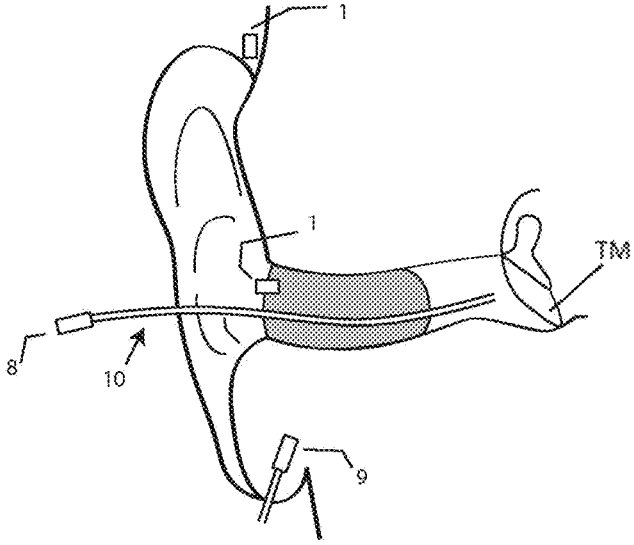
FIG. 4 is a representation of the step (D), that is, the REAG measurement (Real Ear Aided Gain) performed with a microphone attached to a probe tube for sampling the audio signal near the tympanic membrane in the ear when the hearing aid is inserted and a microphone outside the ear, positioned on the subject's face.

In FIG. 4 are represented the sampling points for the audio signals that contribute to the REAG measurement (Real Ear Aided Gain), i.e., the detection of sound pressure at the tympanic membrane in the ear when the hearing aid is inserted carried out by a microphone (8) connected to a probe tube (10) and a "reference microphone" (9) outside the ear, positioned on the subject's face. Such measurement is the object of Step (D) of the method according to the invention, a detailed description of which is the following:

Step (D): the REAG measurement (Real Ear Aided Gain) is a sound pressure measurement performed with a microphone (8) ("measurement microphone") to which a probe tube (10) is connected, which, passing through or externally to the earplug (snail), allows the sound sampling near the tympanic membrane in the ear (REAR—Real Ear Aided Response), with respect to a sound pressure measurement performed with the "reference microphone" (9), positioned on the subject's face outside the ear. The REAG measurement is obtained by comparing the REAR measurement (Real Ear Aided Response) with sound pressure measurement at "reference microphone" (9).

The method according to the invention provides that the hearing aid must be turned on during the measurement referred to in this step (D).

The presence of the probe tube (10), required for sampling the audio signal near the tympanic membrane in the ear when the hearing aid is inserted, entails some problems because its presence can have a considerable effect on sound pressure measurement to be performed.

In particular, the proximity to the tympanic membrane and the appropriate distance from the sound outlet (sound emission hole) of the hearing aid, of the sound sampling point, are crucial in order to obtain a correct sound pressure measurement in a predetermined range of frequencies.

The fulfillment of the requirement of a distance from the tympanic membrane, of the sound sampling point, less than $\lambda/4$, where $\lambda$ is the wavelength inversely proportional to frequency, it is essential for the purposes of avoiding pressure nulls [HallMueller1997]. As can be seen from the above, this distance depends on the maximum frequency to be measured correctly. For measurements with an hearing aid inserted, in addition to the requirement of proximity to the tympanic membrane, it must also be satisfied the requirement of an adequate distance of the sound sampling point from the sound outlet (sound emission hole) of the hearing aid [BurkhardSachs1971].

Precisely in this regard, it is worth highlighting that the REAG measurement with an apparatus turned on described in EP 2640095 is carried out with a "channel microphone" inserted in the apparatus to sample the sound near the sound outlet of the apparatus. This limits the maximum frequency measurable correctly. In the specific case of EP 2640095 A1, the maximum frequency does not exceed 1000 Hz: precisely below this frequency, the effects of the occlusion of the canal by an occluding object become more significant.

Returning to the REAG measurement (Real Ear Aided Gain) referred to in step (D) of the method according to the present invention, a simultaneous equalization was carried out both of the frequency response of the "reference microphone" (9), and applied during sound generation, and of the signal acquired by the microphone (8) connected to the probe tube (10), and applied during the analysis of the measured signal. The purpose of the two equalizations is to take into account the frequency behaviour of the "reference microphone" (9) and the probe tube (10), respectively.

For this measurement, the hearing aid used (that is, the hearing aid worn by the subject) is programmed in a conventional manner, and these settings do not depend on the person's deafness.

A logarithmic representation (decibels) in the frequency domain is calculated by the REAR measurement, and the difference with respect to the logarithmic representation (decibels) in the frequency domain of the respective sound pressure measurement performed with the "reference microphone" (9) is calculated, thus obtaining the logarithmic representation (decibels) in the frequency domain of REAG. Alternatively, in case of non-logarithmic representation, a quotient can be calculated.

Step (E): after obtaining the logarithmic frequency domain representation of REUG, the component of the Insertion Gain (REIG) to be corrected/compensated, herein called POST, is calculated.

This component of REIG is calculated as the difference between the logarithmic frequency domain representations of REAG and REUG to which the PRE component is to be subtracted, in other terms (REAG−REUG)−PRE. This component will be called herein POST. It is also expressed in logarithmic scale (dB) and covers a range of frequencies ranging from 100 Hz to 10000 Hz. It is the combined effect on sound due to the "passive" presence of the hearing aid (i.e. with receiver turned off) and the frequency behaviour of the receiver within the residual meatus.

In summary, POST is the propagation alteration of sound due both to the hearing aid as an occluding "passive" object, and to the in situ frequency response of the receiver. By the term in situ frequency response of the receiver is meant the frequency behaviour of the receiver inside the space remaining between the extremity of the hearing aid and the tympanic membrane, said behaviour being dependent on the shape and size of the residual meatus and on the interaction with the Tympanic Membrane (TM). This interaction will be defined herein as the receiver-tympanum coupling: the amount of displacement of the tympanic membrane is proportional to the sound pressure generated by the receiver, which, in turn, depend on the variation of sound pressure produced inside the residual meatus by the displacement of the tympanic membrane.

The sum of the two components so identified and measured in steps (C) and (E) of the method, i.e., PRE and POST, is the Insertion Gain (REIG) hearing aid, that is, the difference between the sound pressure at the tympanic membrane in the ear with a hearing aid set in a known manner and not dependent on the deafness, and the sound pressure at the tympanic membrane without hearing aid.

Step (F): once the REIG component, POST, is calculated, the compensating filter of that component will be designed.

The design strategy is based on an optimization algorithm not constrained to average p-th error, where p are values ranging from 2 to 128. The optimization is achieved when the average p-th error is minimized.

The correction of the POST component of REIG, performed by the block (4) of the apparatus according to the invention, is carried out on the broadband signal reconstituted downstream of deafness processing performed by the block (3) of the apparatus according to the invention.

Once translated in the programming software, the filter is not changed.

Any possible non-perfect compensation of the POST component of the Insertion Gain (REIG) obtained in step (F) can be corrected according to the step (G) of the method by the use of equalization filters residing in the deafness-processing unit (3).

Figure 5:
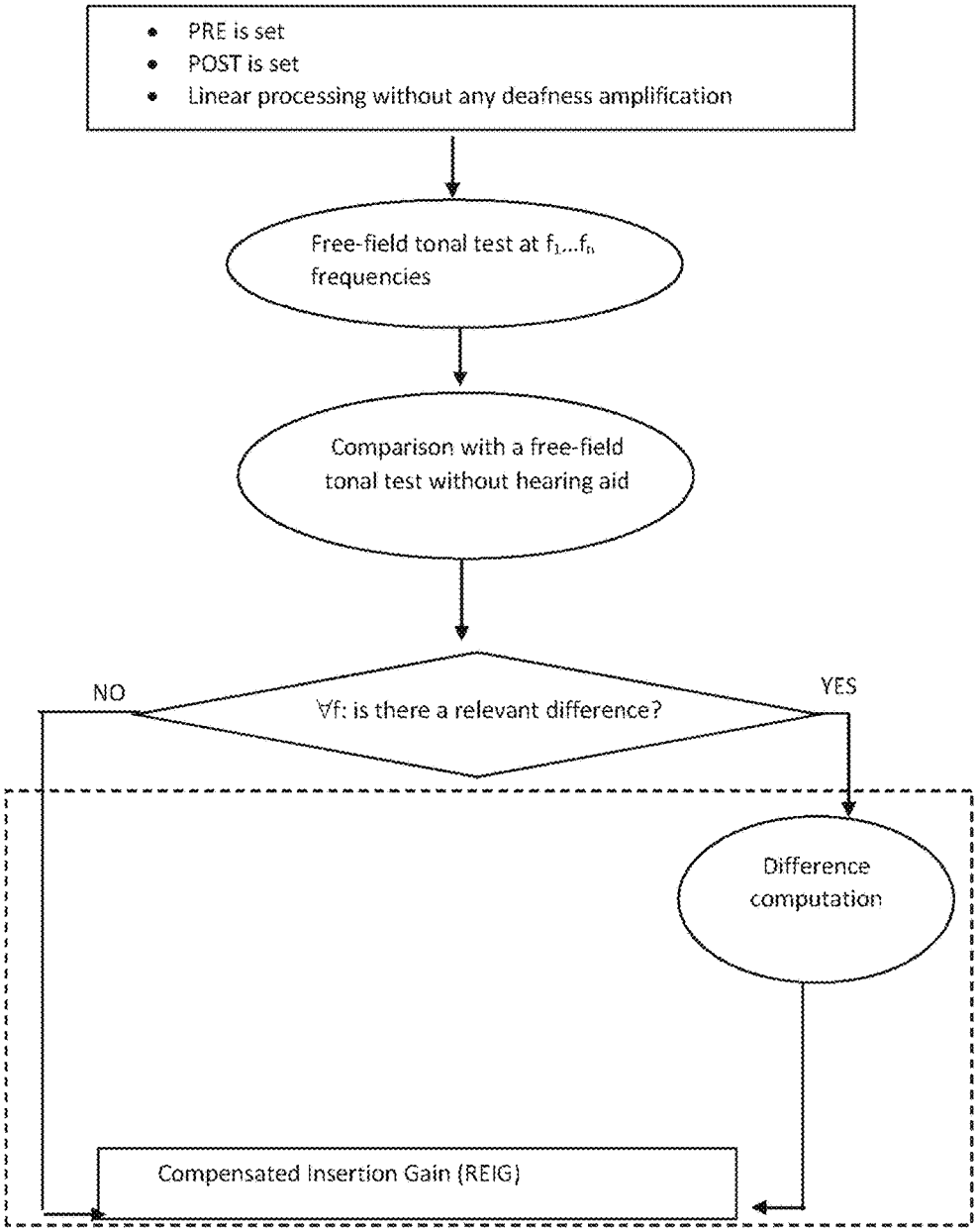
FIG. 5 is a flowchart illustrating the refinement procedure of step (G) of the method according to the invention, to correct a possible non-perfect compensation of the Insertion Gain (REIG) obtained by the compensating filter in step (F)

In FIG. 5 shows a flow diagram that illustrates the basic steps, for each test frequency, of the step (G) for testing and verification of the compensating filter of REIG on the subject wearing a hearing aid, and relevant for performing a refinement procedure to correct any non-perfect compensation of the Insertion Gain (REIG) carried out by the compensating filter of the step (F). The permanent compensation of REIG performed by the blocks (2) and (4) of the apparatus according to the invention is open loop applied and split into its two components by applying the first one upstream of deafness processing (block (2)) and the second one downstream of deafness processing (block (4)). The possible correction from the refinement procedure of step (G) and performed by the block (3) of the apparatus according to the invention is also open loop applied.

Step (G): once the blocks (2) and (4) are set, the parameters of the block (3) are set for deafness processing in such a way that no additional amplification is supplied and the processing is linear, followed by a free field tonal test on the subject wearing a so-set hearing aid. The tonal test is performed by the presentation of variable frequency tonal stimuli as per UNI EN ISO 8253-2 to which intermediate frequencies can be added for a greater accuracy.

The result of the tonal test so performed is compared with that previously obtained by presenting to the subject the same sound stimuli, but with a free ear (without hearing aid).

Any non-perfect coincidence of the two results can be corrected by a refinement procedure aimed at computing the difference between the two audiometric tests, on the same set of tested frequencies, and compensating the difference found by setting refinement parameters to such a difference.

A simple implementative solution to correct this difference could be the use of the equalization filters within the block (3).

At the end of step (G) of the method according to the invention, the hearing aid is therefore tuned with settings not dependent on deafness, but which are such as to compensate for the Insertion Gain (REIG) of the apparatus. It is a first programming level of the hearing aid.

The hearing aid as set, i.e. with configured compensating filters, with the configured equalization filters (to correct any non-perfect compensation of the Insertion Gain performed by the blocks (2) and (4)) and other parameters set so as to not provide additional amplification and to operate in a linear fashion, it is such as to ensure that the sound pressure at the tympanic membrane in the ear of the subject corresponds to that which would occur if the ear was free, i.e. without hearing aid. In this manner, the behaviour of the outer ear with varying of the sound power is also preserved. In other words, the characteristics with which the response of the outer ear changes with varying of the power of the incident audio are maintained unchanged.

During this phase, the subject is also asked to answer a questionnaire containing questions to compare the sound perception by means of the hearing aids so tuned with the sound perception without hearing aids.

Figure 6:
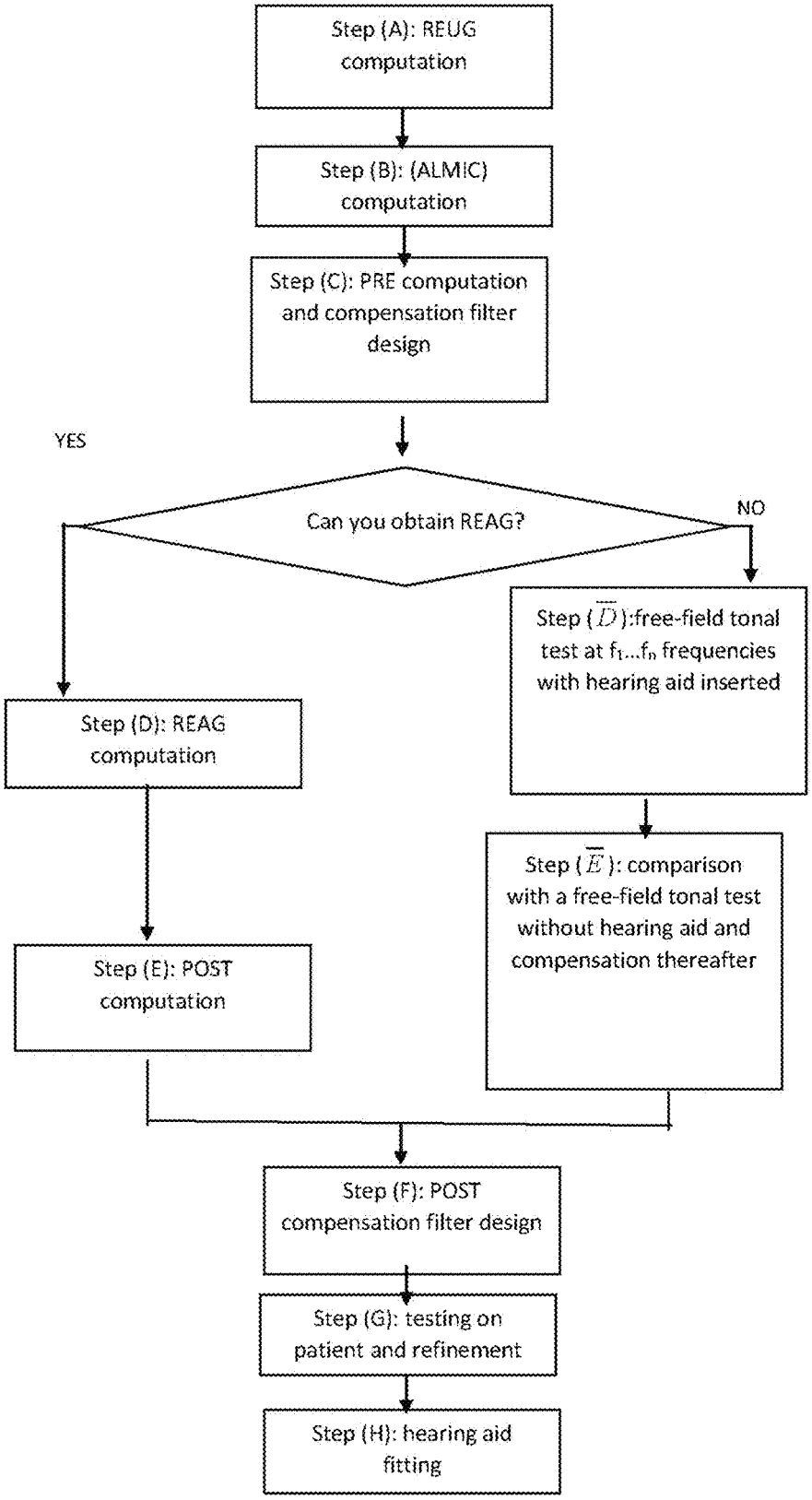
FIG. 6 is a flow diagram illustrating the steps of the method according to the present invention.

Once the compensation of the Insertion Gain through the steps AG is reached, the present method involves the step (H) to set the electro-acoustic parameters of the hearing aid to correct deafness taking into account the compensating filter of the Insertion Gain (REIG). The steps of the method according to the present invention are described by the flow chart shown in FIG. 6.

The method according to the invention is configured as applicable for any of the various kinds of deafness that, depending on the damaged area, are divided into transmission, sensorineural, mixed, and central deafness. In the transmission deafness the damage is located in the ear part for the mechanical transmission of the sound, that is the tympanic membrane and the ossicles; in the perceptive or sensorineural deafness the damage is in the cochlea and/or the auditory nerve; the mixed deafness have a mechanical and a sensorineural components; the central deafness results from a damage within the brain.

Step (H): the parameters of the block (3) of the inventive apparatus are set for deafness processing in order to compensate for the hearing loss, taking into account the compensating filter of the Insertion Gain (REIG).

In particular, the set parameters are those involved in the non-linear multi-channel amplification performed by the block (3) of the apparatus according to the invention.

The multichannel functionality operates by decomposing the broadband signal resulting, in the present invention, from the operation of Fast Fourier Transform (FFT) performed on the signal acquired from the microphone (1) of the hearing aid in a number of channels, that is, frequency bands, whose location and dimension can be set by the operator, i.e., the hearing care professional.

A possible criterion for selection of these frequency bands can be to group together, in a same channel, frequency values on which the free field tonal test has produced similar results, that is, frequency values on which the hearing loss of the person is similar. This choice is useful in order to simplify the programming of the apparatus by the hearing healthcare professional to correct deafness, which is the setting of parameters within the processing unit concerning the non-linear amplification, as the compression threshold, the compression ratio, the channel gain.

The channel gain is the amplification to be made from the hearing aid on that specific frequency band in order to compensate for the hearing loss in that frequency region.

The gain setting of the channel in the method according to the invention is simplified. The channel gain, $G_0$, on a logarithmic scale (decibels), can be calculated in the following manner:

$$G_0=R-A$$

where A is the mean value of the unaided hearing thresholds of the subject in a defined frequency region and grouped in the considered channel, and R is the mean value of the aided hearing thresholds for the subject in the same frequency region. A and R are expressed in the same unit of measure, conventionally in HTL dBs (Hearing Threshold Level).

In the choice of R, the method according to the present invention provides a gradualness criterion in case of a first-time prosthesis subject. This means that the subject will be only gradually brought to the desired R value by means of intermediate steps when tuning the parameters. The gradualness criterion, which applies to the first-time prosthesis subjects, also refers to the fact that the R values can be chosen, in the first instance, in order to preserve the relationship between the frequency values represented by the result of the tonal test carried out in order to establish the hearing threshold of the person.

Once the channel gain, $G_0$, is calculated, the other parameters of the deafness-processing unit are then adjusted, which regulate the non-linear amplification, including the compression thresholds and the compression ratio.

The compression thresholds, $S_{inf}$ e $S_{sup}$, represent, for each channel, a range of sound pressure levels, expressed in SPL dBs (a measurement of sound pressure, expressed in decibels, with respect to the threshold of hearing. The threshold of hearing is usually defined as 20 micropascals, which is assigned a value of 0 decibels), for which the amplification performed by the hearing aid is compressed, so to speak, i.e. the channel gain follows the relationship below:

$$G=G_0-(S-S_{inf})/CR$$

where $G_0$ is the channel gain on a logarithmic scale set for the linear amplification phase, $S_{inf}$, expressed in SPL dBs, represents the lower limit of the sound pressure within which the non-linear amplification phase is valid, S is a sound pressure level in SPL dBs within that range, that is $S_{inf} \leq S \leq S_{sup}$, and CR is the compression ratio, i.e., the amount of compression.

The criteria underlying the choice of the values to be given to the compression thresholds and the compression ratio, in the method according to the present invention, is not unique and can be aimed, for example, either at the maximization of the hearing yield, that is, the hearing threshold with hearing aid, or to maximize the speech intelligibility of the subject, that is, his/her ability to recognize and understand words and sentences of a language.

Both in the case of tuning the electro-acoustic parameters of the hearing aid (maximization of the yield) and the case of tuning for intelligibility (maximization of speech intelligibility), the method according to the present invention provides for the tuning of the hearing aid taking into account the compensating filter of the Insertion Gain (REIG). One way to do this is, for example, to add $S_{inf}$, channel by channel, with the mean value of the PRE function on the channel frequency domain. In such a way the frequency response of the compensating filter of the PRE component, performed in the block (2) of the apparatus (100) according to the invention, aimed at restoring the main resonance of the ear canal and of the contribution of hollow part of the outer ear associated with frequencies in the range 4 kHz-6 kHz involved in sound localization, is preserved.

In a similar manner, the maintaining of frequency behaviour of the compensating filter of the PRE component by $S_{sup}$ can be obtained by adding $S_{sup}$ with the mean value of the PRE function on the channel frequency domain or by setting $S_{sup}$ channel by channel, from the corresponding $S_{inf}$ and taking into account the related channel gain, $G_0$.

With regards to the setting of the compression ratio, CR, channel by channel, the method according to the present invention provides to take into account both the auditory range of the subject, i.e. the range delimited by the minimum audible threshold and the discomfort threshold, and the hearing threshold by bone conduction.

Figure 7A:
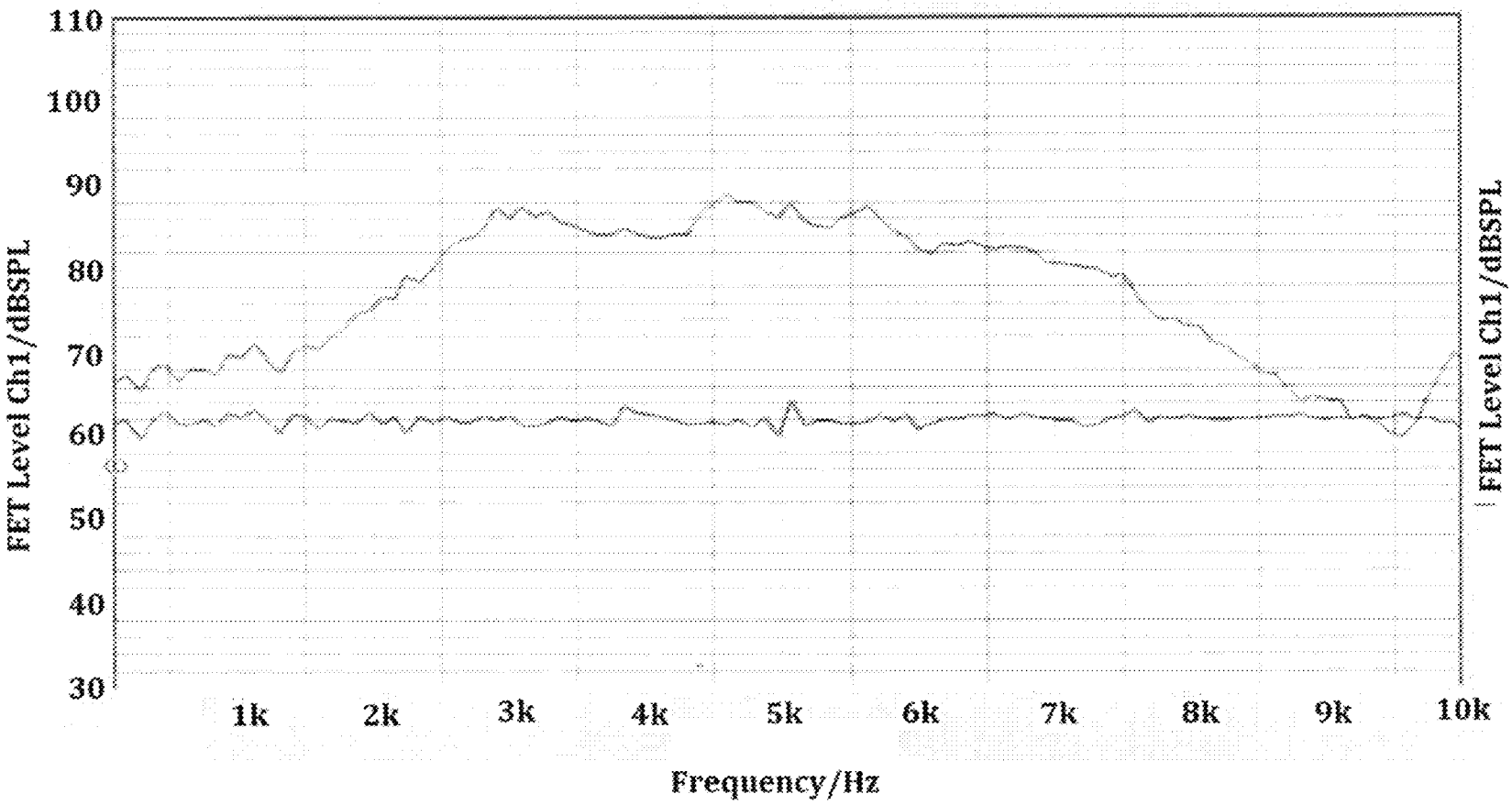
FIG. 7 is a logarithmic scale representation (dB) of the signals associated with the REUG, ALMIC and REAG measurements in the frequency domain.
Figure 7B:
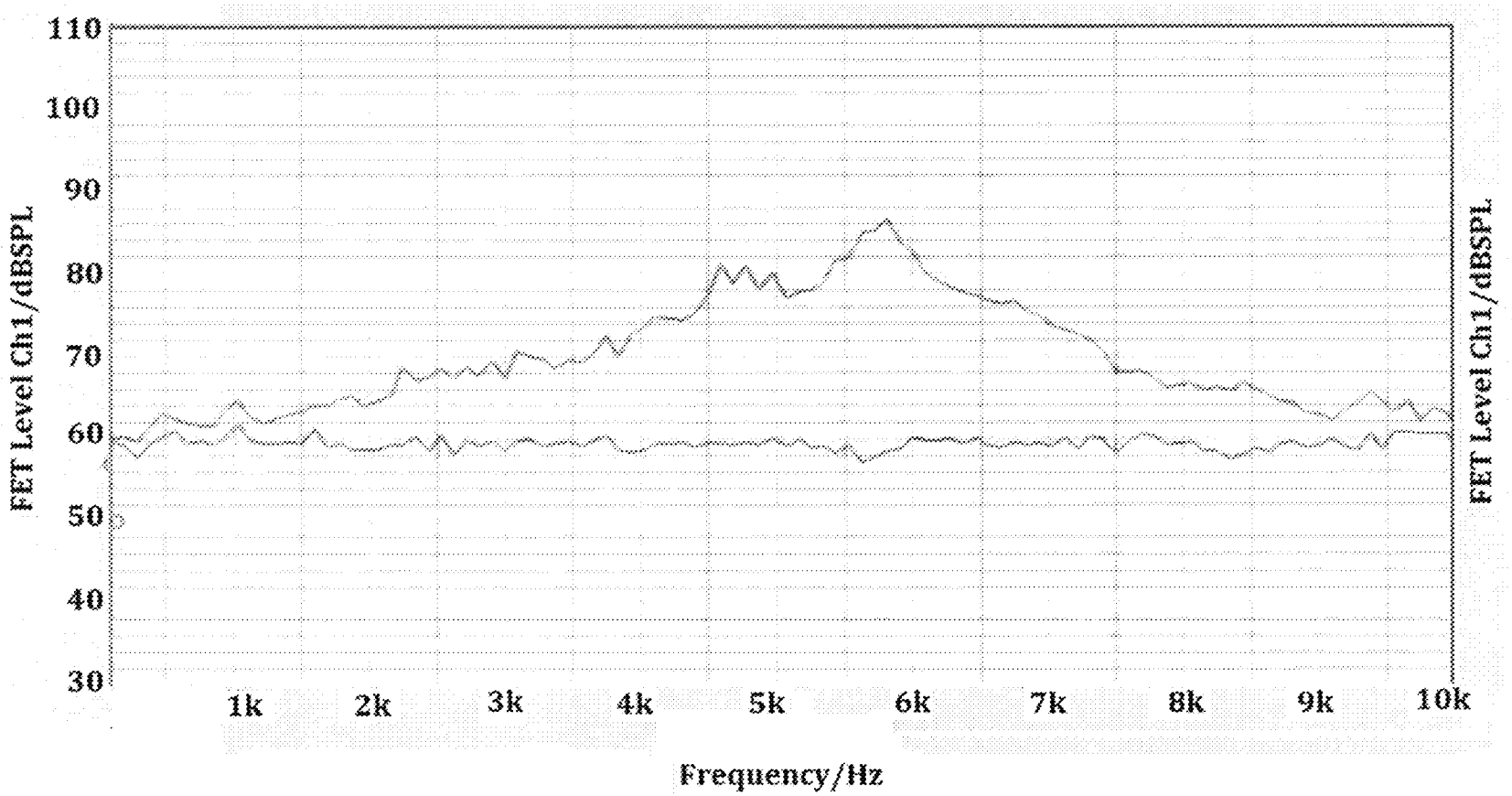
Figure 7C:
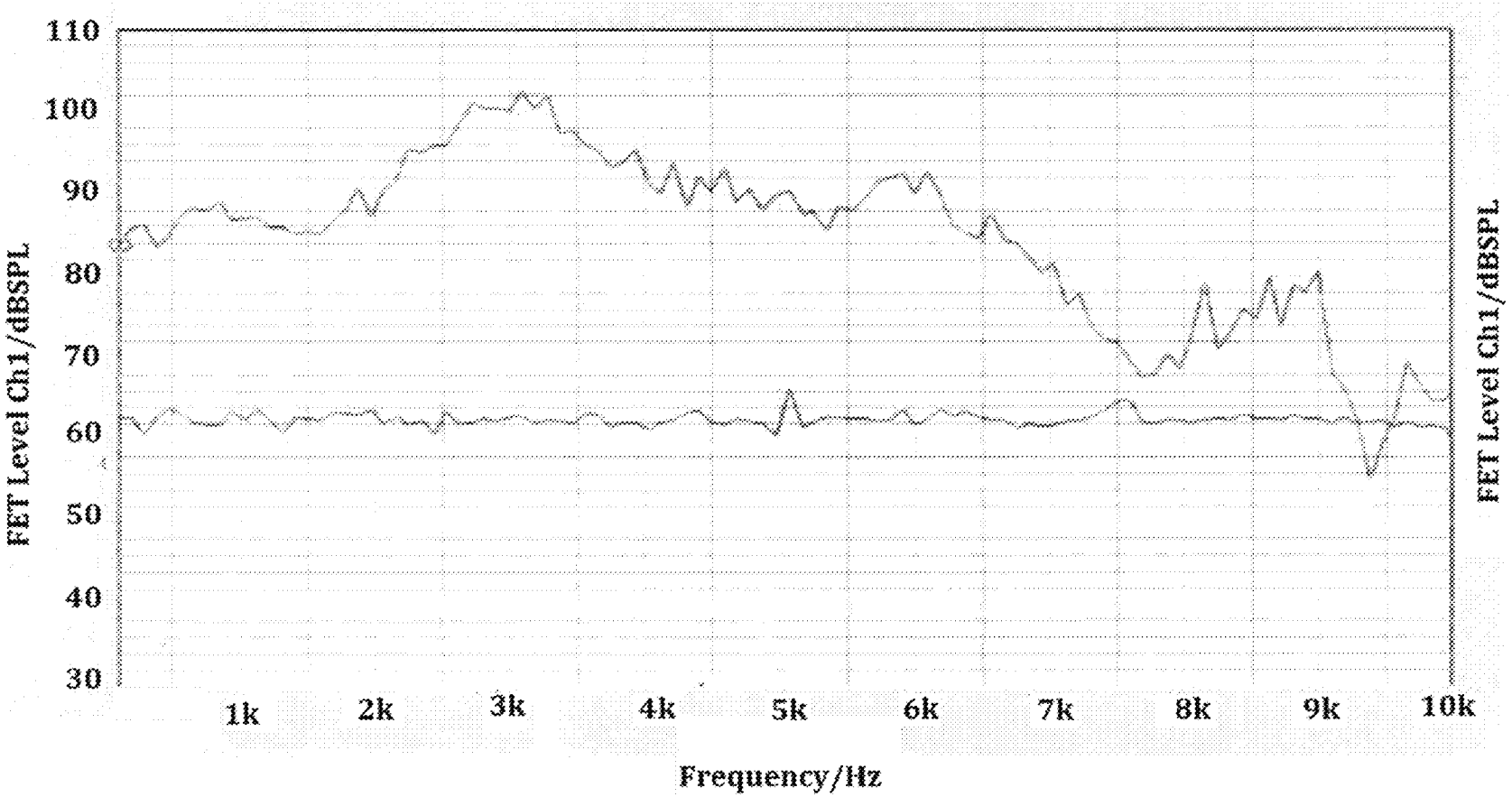

FIG. 7 shows the signals associated with REUG, ALMIC and REAG measurements, referred to the steps (A), (B), (D) of the method according to the present invention. The sound stimulus used is generated by an external loudspeaker under free field conditions. It is a broadband stimulus, specifically a white noise fenestrated in the band 100 Hz-10000 Hz. Several types of sound stimuli can also be used.

In particular, 7A shows the detected signal at the tympanic membrane of a free ear, that is, REUR (Real Ear Unaided Response), along with the corresponding signal acquired from the "reference microphone" (9) outside the ear whose frequency response is equalized by means of a simultaneous equalization applied when generating the sound stimulus. Both of these signals are expressed in decibels. Their difference produce the REUG signal (Real Ear Unaided Gain) referred to in step (A) of the method according to the invention.

7B shows the signal acquired from the microphone of the hearing aid (1), in this case an ITE hearing aid, along with the corresponding signal acquired from the "reference microphone" (9) outside the ear whose frequency response is equalized by means of a simultaneous equalization applied when generating the sound stimulus. Both of these signals are expressed in decibels. Their difference produce the REUG ALMIC referred to in step (B) of the method according to the invention.

7C shows the detected signal at the tympanic membrane in the ear with hearing aid inserted, that is, REAR (Real Ear Aided Response), along with the corresponding signal acquired from the "reference microphone" (9) outside the ear whose frequency response is equalized by means of a simultaneous equalization applied when generating the sound stimulus. On the contrary, in the analysis phase of the measured signal, a simultaneous equalization of the acquired signal from the microphone connected to the probe tube (10) is applied, in order to take into account the frequency behaviour of the probe tube. Both of these signals are expressed in decibels. Their difference produce the REAG signal (Real Ear Aided Gain) referred to in step (D) of the method according to the invention.

The difference between ALMIC and REUG is the PRE component of the Insertion Gain (REIG). The visual comparison of 7A and 7B shows clearly the disappearance of the main resonance with a free ear, which in this case is around about 2900 Hz, and the alteration of the contribution of the hollow part of the outer ear associated to the frequencies in the range 4 kHz-6 kHz involved in sound localization.

The alteration of the contribution of the hollow part in 7B may be more or less high, depending on the position of the microphone (1) of the hearing aid. The alteration will be highest in the case of a BTE hearing aid.

The difference between REAG and REUG produce the POST component of the Insertion Gain (REIG), which is the combined effect on sound due to the "passive" presence of the hearing aid (i.e. with receiver turned off) and the frequency behaviour of the receiver within the residual meatus. In general, the visual comparison of 7A and 7C shows clearly that the sound pressure near the tympanic membrane in the ear is greater in the presence of a hearing aid on almost the entire range of frequencies considered.

Implementation Options

Further and alternative embodiments of the proposed solution can be male compared to the embodiment illustrated above and claimed below but still falling within the solution concept underlying the example. In particular, the present invention can be realized with technical equivalents suitable for the purpose and with supplementary measures and conformations of constituent parts changed in a suitable way, but consistent with the proposed solution.

In particular: the method according to the present invention is susceptible of some of the variants described in the following as Variant 1 ($V_1$) and Variant 2 ($V_2$).

The Variant 1 consists of eight steps of the method according to the invention in which, however, in step (C) only the calculation of the PRE component of the Insertion Gain (REIG) is carried out, and in step (F) the design of a single compensating filter is performed, both of the PRE component and of the POST component of the Insertion Gain (REIG).

The Variant 2 consists of eight steps of the method according to the invention in which, however, in step (D) the sound sampling is performed by placing a microphone near the tympanic membrane in the ear, without probe tube connected. The feasibility of this operative mode is the ability to use a flat cable made on a flexible printed circuit (Kapton® type or the like), which can be inserted between the snail and the ear canal.

Some embodiments, implementable in any case by the method and for the variants of the method just described, and which relate to different possible architectures that can be used to implement the blocks (2), (3), (4), (6), (7) of the apparatus (100) according to the invention described in FIG. 1, are described briefly below.

Among the architectures that can be used include the Digital Signal Processor (DSP) to perform the digital signal processing in an ad hoc and optimized manner, the field programmable gate array (FPGA) having intermediate features between the ASIC devices (Application Specific Integrated Circuit) and those with PAL architecture (Programmable Array Logic), both of which being usable as possible architectures, and more generally one chipset suitable in terms of size, power consumption, and footprint compatible with the use in a hearing aid.

In addition, depending on the architecture used, the implementations of the blocks (2) and (4) of the apparatus (100) according to the invention, described in FIG. 1, will be variable, in order to obtain the permanent compensation for the PRE and POST components of the Insertion Gain (REIG). In particular, the compensating filter of the Insertion Gain implemented by the blocks (2) and (4) may for example operate in the time domain or in the frequency domain.

INDUSTRIAL APPLICABILITY

With regards to the the areas of application of the method according to the invention, the proposed solution is applied mainly to the digital hearing aids. Therefore, the steps A-G- of of the method are applicable also in areas outside of the hearing aids and concerning, for example, headphones (for example, for hearing protection purposes, music listening, alert reports, acoustic monitor). Again in the context of hearing disturbances, it is worth highlighting the applicability of the steps A-G of the method according to the invention in normal hearing subjects suffering from tinnitus, for which a hearing aid can be used in the form of sound masking system, i.e., a noise generator which masks the whistle perception (tinnitus) by the subject. The application of the steps A-G of the present method will provide such apparatus with the ability of not altering the spectral cues of an audio signal, including those used by the auditory system for the location of a sound source and that are particularly important for speech intelligibility in noisy environments. In the context of the hearing aids, the steps A-H of the method according to the invention are also applicable to a so-called "hybrid" type of prosthesis, which involves the application of a hearing aid and a cochlear implant on the same side, and to a so-called "bimodal" type of prosthesis, which involves the application of a hearing aid on one side and of a cochlear implant on the other side. Again in the context of the hearing aids, it is worth highlighting that the steps A-H of this method simplify the prosthetization performed by a hearing healthcare professional of subjects suffering from a slight hearing loss.

The invention claimed is:

1. Method for preserving spectral cues of an audio signal altered by the physical presence in the hearing canal of a hearing aid or a part of it; said hearing aid comprising:

a microphone for detecting environmental sounds;

a speaker (receiver) for emitting an audio signal into the ear canal of a patient;

a set of signal processing instruments for preserving the spectral cues of an audio signal and compensating for deafness;

Said processing instruments comprising:

i a compensating filter, positioned in an open loop configuration between the microphone of the hearing aid and its signal processing unit for pre-processing of the input audio signal;

ii a signal processing unit which includes a non-linear multi-channel amplifier, a algorithm for noise reduction, an anti-Larsen effect block and a set of equalizing filters;

iii a second compensating filter; positioned in an open loop configuration between the signal processing unit of the hearing aid and its speaker (receiver) for the post-processing on the audio signal to be emitted in the ear canal;

Said method consisting of eight steps (A-H) of which the first seven steps (A-G) are aimed at calculation and reset of the Insertion Gain (Real Ear Insertion Gain=REIG=REAG (Real Ear Aided Gain)-REUG (Real Ear Unaided Gain)=0) and the eighth step (H) comprising the tuning of electro-acoustic parameters of the hearing aid; said method being characterized by splitting the REIG function in two components called PRE and POST and by the following steps:

A Calculating the REUG (Real Ear Unaided Gain) computed as the difference between the sound pressure level (SPL) detected by a microphone positioned in the hearing canal near the tympanic membrane and the SPL detected by a reference microphone placed on the patient's face, next to his ear; said SPL being defined as: $20\times\log_{10}(P/P_0)$ where P is the given sound pressure and $P_0$ is the reference sound pressure (20 μPa);

B Calculating the gain computed as the difference between SPL detected by the microphone of a hearing aid, with SPL detected by a reference microphone placed on the patient's face, next to his ear, said gain is ALMIC gain;

C Calculating the PRE function, i.e., the first component of the Insertion Gain, for the pre-processing of the signal acquired from the microphone of the hearing aid, computed as the difference between ALMIC and REUG expressed on a logarithmic scale (dB) in the frequency domain and setting the first compensating filter of the hearing aid to match the PRE function;

D Calculating the REAG (Real Ear Aided Gain) computed as the difference between SPL near the tympanic membrane in the hearing canal detected by a microphone to which a probe tube is connected, which passes through or externally to the hearing aid inserted in the ear, and SPL detected by a reference microphone placed on the patient's face, next to his ear;

E Calculating the POST function, i.e., the second component of the Insertion Gain, computed as REAG−REUG−PRE, expressed on a logarithmic scale (dB) in the frequency domain;

F Setting the second compensating filter of the hearing aid, for the post-processing of the output signal from the processing unit, to match the POST function computed in the previous step E;

G Performing two free field audiometric tests with and without hearing aid inserted, according to the UNI EN ISO 8253-2, and then setting the refinement parameters for the two compensating filters previously mentioned, to the difference computed between the two audiometric tests, on the same set of tested frequencies;

H Setting the electro acoustic parameters of the hearing aid, i. e., the channel gain, $G_0$, according to the equation $G_0=R-A$, where R and A are the mean value of the aided hearing thresholds (R) and unaided hearing thresholds (A) in the channel frequency domain, and the channel compression thresholds;

wherein the second compensating filter matches the POST function.

2. Method according to claim 1, wherein the step B is characterized in that the electrical signal outputted from the microphone of the patient's hearing aid is used for the calculation of the ALMIC gain.

3. Method according to claim 1, wherein the step G is characterized in that the two compensating filters are refined by means of the digital equalizers of the hearing aid's processing unit.

4. Method according to claim 1, step H, where such channel compression thresholds, $S_{inf}$ (Lower Threshold) and $S_{sup}$, (Upper Threshold) are added with the mean value of the PRE function on the channel frequency domain.

* * * * *